US006497104B1

(12) United States Patent
Thompson et al.

(10) Patent No.: US 6,497,104 B1
(45) Date of Patent: Dec. 24, 2002

(54) DAMPED COMBUSTION COWL STRUCTURE

(75) Inventors: James Edward Thompson, Middletown, OH (US); Bernard Mc Arthur Knippenberg, Lawrenceburg, IN (US); Robert Bruce Walmsley, Moscow, OH (US)

(73) Assignee: General Electric Company, Schnectady, NY (US)

( * ) Notice: Subject to any disclaimer, the term of this patent is extended or adjusted under 35 U.S.C. 154(b) by 0 days.

(21) Appl. No.: 09/699,542

(22) Filed: Oct. 30, 2000

(51) Int. Cl.[7] ..... F23R 3/42
(52) U.S. Cl. ..... 60/796; 60/752
(58) Field of Search ..... 60/39.31, 39.32, 60/39.37, 722, 752, 725, 796, 797, 798, 799, 800; 431/350, 353, 114

(56) References Cited

U.S. PATENT DOCUMENTS 3,186,168 A * 6/1965 Ormerod et al. ..... 60/39.32
3,692,334 A * 9/1972 Doyle et al. ..... 285/187
3,844,847 A * 10/1974 Bomford et al. ..... 419/50
4,126,029 A * 11/1978 Mathur ..... 72/69
4,173,134 A * 11/1979 Huuskonen et al. ..... 72/10
4,191,011 A * 3/1980 Sweeney et al. ..... 60/39.32
4,555,901 A * 12/1985 Wakeman et al. ..... 60/39.32
4,854,122 A * 8/1989 Belling ..... 60/39.32
5,181,377 A 1/1993 Napoli et al. ..... 60/796
6,134,877 A * 10/2000 Alkabie ..... 60/39.32

* cited by examiner

*Primary Examiner*—Ted Kim
(74) *Attorney, Agent, or Firm*—William Scott Andes; Barbara Joan Haushalter

(57) ABSTRACT

A method is provided for increasing the contact area between a damper wire and a sheet metal component in a combustion cowl of a gas turbine engine. This increase in contact area reduces the wear rate on the combustor cowl. A first curl is formed in the sheet metal component. A damper wire is situated to have a common contact area with the sheet metal component within the first curl. The first curl is die-formed around the damper wire before applying a heat treat operation to the structure. A final die-form closes the sheet metal curl around the damper wire.

9 Claims, 3 Drawing Sheets

DAMPED COMBUSTION COWL STRUCTURE

FIELD OF THE INVENTION

The present invention relates to an improved sheet metal structure, and more particularly to an improved cowl damping structure for use in the combustion chamber of a gas turbine engine.

BACKGROUND OF THE INVENTION

In a combustor of a gas turbine engine, guide vanes direct pressurized air from the compressor. This air moves over the inner and outer liners of the combustion chamber, or combustor, to provide a cooling effect. Gas turbine combustors generally require a combustion cowl for dividing the incoming air into the primary zone dome flow and into the upper and lower combustor annulus air flows. The impinging air from the compressor exit causes the cowl to vibrate mechanically, which leads to high cycle fatigue of the cowl.

In the existing art, a formed sheet metal part is rolled on a forward end to encase a continuous damper wire. Typically gaps or spaces exist between the formed sheet metal part and the damper wire where they are not in contact with each other. The locations where the components are in contact with each other produces a sliding friction force between the wire and the sheet, which dampens the vibration force. Over a long time exposure, the wire-damped cowl having such gaps experiences typical wear problems associated with friction damping systems. The wear causes thinning of the sheet metal that leads to a shortened part life, requiring frequent replacement of the combustion cowl.

It would be desirable, then, to improve the cowl damping structure in a gas turbine combustor, by improving or increasing the contact area between the damper wire and sheet metal to reduce the wear rate of the combustion cowl.

BRIEF SUMMARY OF THE INVENTION

To improve the existing cowl design, a cowl wrap wire process is proposed. The manual spinning process of the existing art is eliminated, and replaced with a controlled die-form operation and heat treat. The heat treat will occur after the first curl of the sheet metal around the wire. After heat treat, a final controlled die-form process is applied to close the sheet metal around the wire. This yields a consistent contact area around the part that is greater than the contact area using the existing art process.

In one embodiment of the present invention, a method for increasing contact area between a damper wire and sheet metal component in a combustion cowl of a gas turbine engine is provided. The method comprises of several steps that include the following. Processing a sheet metal component having a forward diameter at a forward end and an aft diameter at an aft end wherein the forward diameter is smaller than the aft diameter. Placing or situating a damper wire onto the sheet metal component adjacent to the forward end so that an area of contact is created between the damper wire and the sheet metal component. Die-forming a first curl in the sheet metal component around the damper wire prior to heat treat to create a cowl wrap wire structure. Applying a heat treat operation to the cowl wrap wire structure to conform the sheet metal component and the wire thereby increasing the area of contact between the damper wire and the sheet metal component. Then die-forming a final curl in the sheet metal component around the damper wire in the cowl wrap wire structure after heat treat to create a combustion cowl.

In another embodiment of the present invention, a combustion cowl for use on a gas turbine engine is provided. The combustion cowl comprising a sheet metal component, a damper wire, and an area of contact between the sheet metal component and the damper wire. The sheet metal component having a forward diameter at a forward end and an aft diameter at an aft end wherein the forward diameter is smaller than the aft diameter. The damper wire on the sheet metal component is adjacent to the forward end. The area of contact between the damper wire and the sheet metal component is increased by applying a first die-forming operation, a heat treat operation, and a final die-forming operation after the heat treat operation in order to curl the forward end of the sheet metal component around the damper wire.

Accordingly, the present invention provides an effective technique for improving the contact area between the damper wire and sheet metal to reduce the wear rate of the combustion cowl.

DETAILED DESCRIPTION OF THE INVENTION

Figure 1:
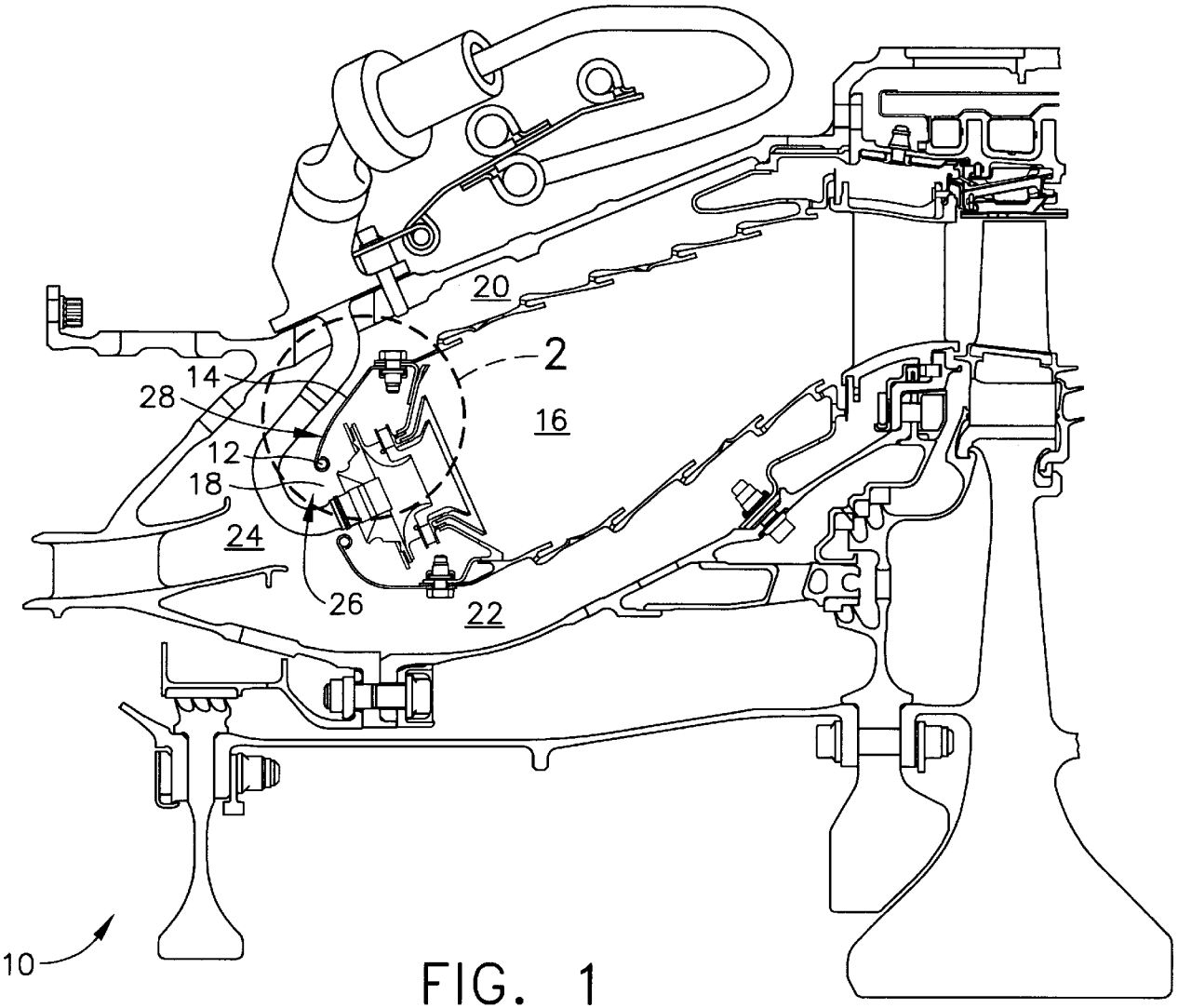
FIG. 1 illustrates a cross-sectional view of an engine combustor region showing a combustor structure.

Referring to FIG. 1, there is illustrated a cross-sectional view of a typical combustor region of a gas turbine engine 10. The wire-damped combustion cowl wrap technique herein can be applied to such an engine 10. In engine 10, the contact area between damper wire 12 and sheet metal 14 is increased which reduces the wear rate on the combustor cowl 28, associated with combustor 16. The combustion cowl divides the air incoming into primary zone dome flow of air region 18 into upper and lower combustor annulus air flows 20 and 22, respectively. Incoming air from the compressor exit 24 causes the combustion cowl to vibrate mechanically. The mechanical vibrations lead to high cycle fatigue of the cowl.

In the prior art, the cowl wrap design produces gaps between the damper wire and sheet metal thereby reducing a sliding friction force between the wire and the sheet, which damps the vibration force. Over a long time exposure, however, the wire-damped cowl experiences typical friction damping system wear problems. The wear causes thinning of the sheet metal that leads to a shortened part life, requiring frequent replacement of the cowl. Such cowl structures have been proposed, for example, in U.S. Pat. No. 5,181,377 issued to Napoli et. al. on Jan. 26, 1993, assigned to the General Electric Company which patent is hereby incorporated herein by reference.

Figure 2:
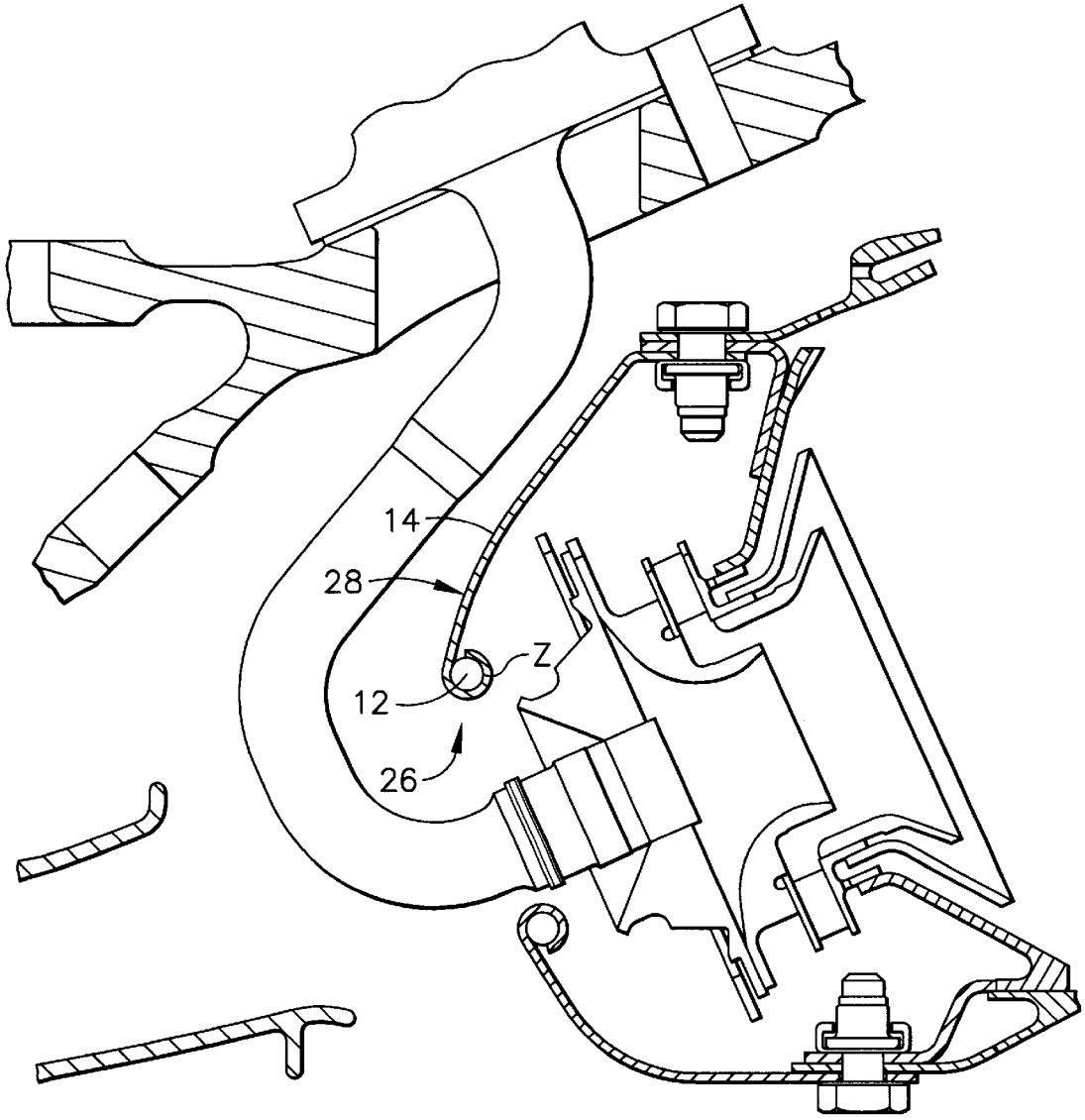
FIG. 2 illustrates a cross-sectional view of a combustion cowl.

Referring now to FIGS. 1 and 2, there is illustrated in greater detail the proposed combustion cowl 28 having the increase in contact area between the damper wire and the sheet metal. Contact area Z and area of contact Z are used interchangeably in reference to the actual surface area where there is physical contact between the damper wire 12 and sheet metal component 14. The formed sheet metal component 14 is rolled on a forward end 26 to encase the continuous damper wire 12. A controlled die-form operation and heat treat wraps the final leg of the sheet around the wire. This reduces the wear rate of the combustion cowl since the gaps in the contact area are eliminated. This controlled die-form yields a consistent contact area around the part that is greater in surface contact area than prior processes. This increased contact area not only significantly reduces wear rate, it also increases part life.

The heat treat occurs after the first curl of the sheet metal 14 around the wire 12. This heat treat operation conforms the sheet metal component 14 and wire 12 increasing the contact area and also eliminating or minimizing gaps between the damper wire and the sheet metal component. After heat treat, a final controlled die-form process is applied to close the sheet metal around the wire. The proposed cowl wrap wire process eliminates the manual spinning form process of the existing art.

Figure 3:
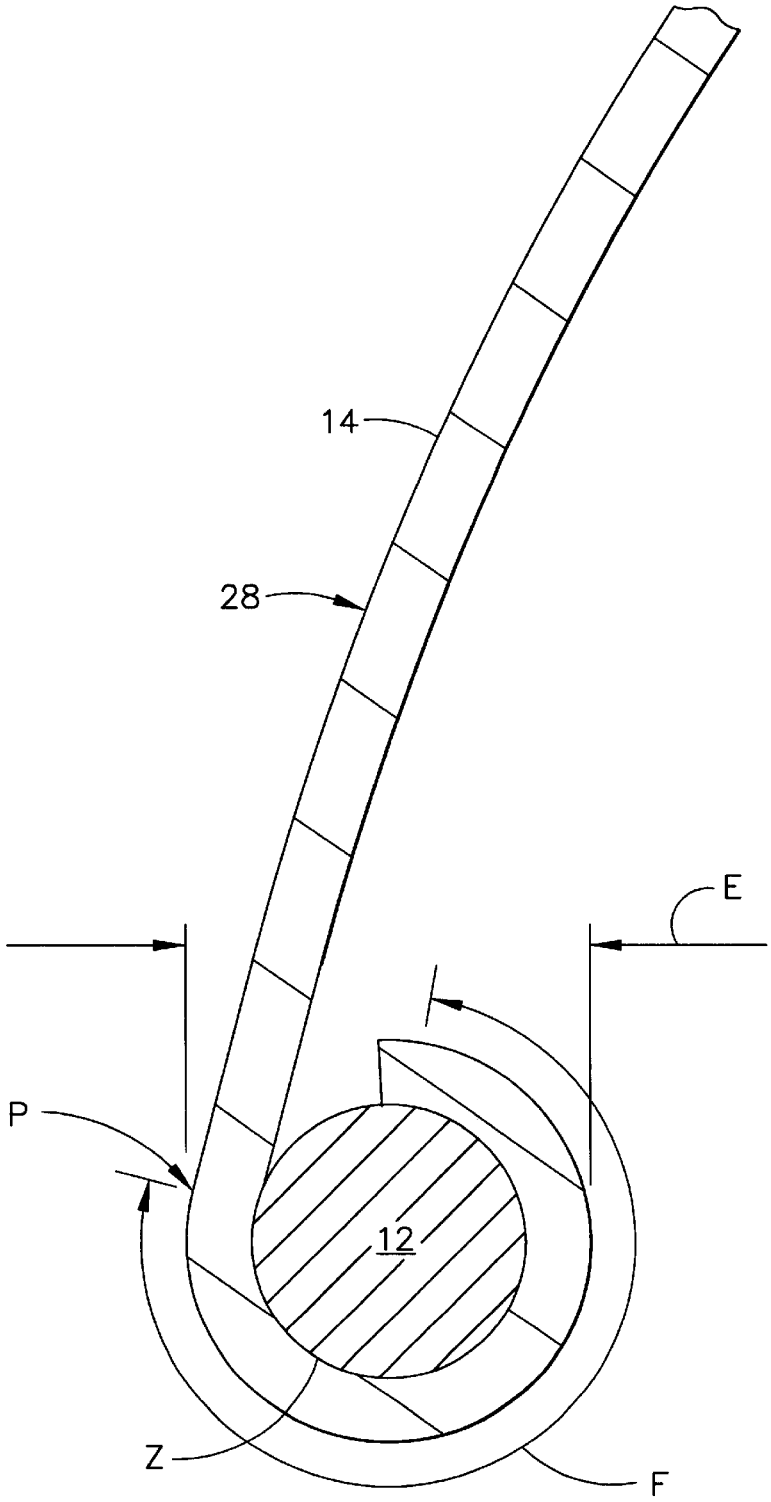
FIG. 3 illustrates a partial view of the combustion cowl from the proposed cowl wrap process.

Referring now to FIG. 3, after completion of this cowl wrap wire process, the combustion cowl 28 includes a diameter E measured across zone F of the combustion cowl 28. Preferably, diameter E can extend anywhere between a maximum value of about 0.25, 0.247, or 0.24 inches to a minimum value of about 0.231, 0.2275, or 0.21 inches; and more preferably diameter E is about 0.239 inches or about 0.2275 inches. Zone F is shown in FIG. 3 on the outer surface of the combustion cowl 28. Zone F extends from a tangent point P to the edge of the combustion cowl 28 in the same direction from tangent point P as the combustion cowl 28 wraps around the wire 12. Zone F may end a maximum distance of about 0.03 inches from the edge of the combustion cowl 28.

In one embodiment of combustion cowl 28 the following preferred parameters apply. The sheet metal 14 is a high temperature metal alloy and has a width or thickness in the range of about 0.03 inches to about 0.05 inches. Preferably the sheet metal 14 has a thickness greater than about 0.03 inches and more preferably between about 0.038 to about 0.042 inches. The wire 12 is made of a high temperature metal alloy and has a diameter in the range of about 0.15 inches to about 0.16 inches. A preferable heat treat temperature is about 2050° F. While a variety of metals can be used for either the wire 12 or the sheet metal 14, a preferred material is a high temperature metal alloy such as a cobalt based alloy. By way of example, the use of a Haynes-188 material wire 12 and sheet metal component 14 can help in reducing wear rate and improving part life.

In this embodiment, one continuous damper wire 12 is used. The damper wire 12 can be formed into an annular shape and made continuous by use of a welded joint. At any such welded joint, the one continuous damper wire 12 may have a local reduction in the diameter.

While the invention has been described with reference to a preferred embodiment, it will be understood by those skilled in the art that various changes may be made and equivalents may be substituted for elements thereof without departing from the scope of the invention. For example, this design can be applied in various environments and to various sheet metal components. In addition, many modifications may be made to adapt a particular situation or material to the teachings of the invention without departing from the essential scope thereof. Therefore, it is intended that the invention not be limited to the particular embodiment disclosed, but that the invention will include all embodiments falling within the scope of the appended claims.

What is claimed is:

1. A combustion cowl with reduced wear rate comprising:

a damper wire;

a sheet metal component having a contact area with the damper wire by applying a first controlled die-form operation and a heat treat operation and then a final controlled die-form operation to wrap an end of the sheet metal component around the damper wire, wherein the contact area is greater than a contact area that can be achieved without the first and final controlled die-form operations.

2. A combustion cowl as claimed in claim 1 wherein the controlled die-form operation yields a consistent contact area around the sheet metal component and the damper wire.

3. A combustion cowl as claimed in claim 1 wherein the sheet metal component comprises a forward end formed in a first curl to wrap around the damper wire.

4. A combustion cowl as claimed in claim 3 wherein the forward end comprises a final curl after application of the heat treat and final controlled die-form operation.

5. A combustion cowl as claimed in claim 4 wherein the final curl encompasses the damper wire after application of a final die-form to close the final curl.

6. A combustion cowl for use on a gas turbine engine, the combustion cowl comprising:

p a sheet metal component having a forward diameter at a forward end and an aft diameter at an aft end and wherein the forward diameter is smaller than the aft diameter;

a damper wire on the sheet metal component adjacent to the forward end; and an area of contact between the damper wire and the sheet metal component wherein the area of contact is a consistent area of contact achieved by applying a first die-forming operation, a heat treat operation, and a final die-forming operation after the heat treat operation to curl the forward end of the sheet metal component around the damper wire, the area of contact being greater than a contact area that can be achieved without the first and final controlled die-form operations.

7. The combustion cowl as claimed in claim 6 wherein the damper wire is one continuous damper wire having an annular shape.

8. The combustion cowl as claimed in claim 6 wherein the curl in the sheet metal component around the damper wire forms a diameter of between about 0.25 inches to about 0.21 inches.

9. The combustion cowl as claimed in claim 8 wherein the damper wire and the sheet metal component are made of a high temperature metal alloy.

* * * * *